United States Patent [19]

Thicke et al.

[11] Patent Number: 4,613,345

[45] Date of Patent: Sep. 23, 1986

[54] FIXED ABRASIVE POLISHING MEDIA

[75] Inventors: Ricky P. Thicke, Stewartville; Stanley B. O'Brien, Hayfield; David M. Nordyke; Dennis L. Fox, both of Rochester; Thomas E. Folkert, Hammond; Bruce R. Diemer, LeRoy, all of Minn.

[73] Assignee: International Business Machines Corporation, Armonk, N.Y.

[21] Appl. No.: 764,909

[22] Filed: Aug. 12, 1985

[51] Int. Cl.[4] ..... B24D 3/00

[52] U.S. Cl. ..... 51/293; 51/309

[58] Field of Search ..... 51/293, 309

[56] References Cited

U.S. PATENT DOCUMENTS

| | | | |
|---|---|---|---|
| 3,295,938 | 1/1967 | Jerome | 51/293 |
| 3,324,605 | 6/1967 | Lester | 51/293 |
| 4,021,263 | 5/1977 | Rosenblum | 51/309 |
| 4,242,842 | 1/1981 | Yancey | 51/309 |
| 4,393,628 | 7/1983 | Ottman et al. | 51/281 SF |
| 4,518,452 | 5/1985 | Hundebol | 51/293 |

*Primary Examiner*—Paul Lieberman
*Assistant Examiner*—Willie J. Thompson
*Attorney, Agent, or Firm*—Robert W. Lahtinen

[57] ABSTRACT

An improved method and formulation is shown for preparing polishing media for superfinishing pure metal surfaces. A combination of hydrophobic and hydrophilic silicone surfactants is used to control the porosity and water absorption during use whereby durability is obtained and the catalyst concentration is regulated to control hardness to achieve durability without scratching the workpiece. Density is controlled by the quantity of mixture with which a closed mold is charged. To produce successful media it is also necessary to preheat the closed mold and to be certain that the resin mixture of particles, polyol and additives does not exceed 120 degrees F. prior to final mixture with isocyanate just before charging the mold and curing. Also a longer cure at a lower temperature enhances the qualities of the resulting polishing media.

10 Claims, 1 Drawing Figure

FIXED ABRASIVE POLISHING MEDIA

BACKGROUND OF THE INVENTION

This invention relates to magnetic memory disks and more specifically, to an improved polishing material for disk substrate polishing.

As the computer industry continues to improve and to increase the magnetic recording densities of the magnetic memory disk, the disk substrate must also evolve. The industry is currently using higher purity aluminum alloys for the substrate to help reduce the number of magnetic defects which are caused by the substrate. When an aluminum substrate has contaminants or alloy materials such as iron, manganese or silicon; the particles of such materials tend to be torn from the surface rather than being sheared off or burnished down during surface finish operations. This causes magnetic imperfections in the resulting magnetic media as small domains of much thicker magnetic coating are randomly present. Small surface irregularities did not significantly impair performance when a fifty millionths thickness magnetic coating was used to form relatively large magnetic domains with track densities of about 500 tracks per inch and bit densities did not exceed 10,000 bits per inch. However with a 10 millionths of an inch magnetic coating thickness, a quarter micron deep void doubles the coating thickness. This becomes even more serious with small magnetic domains as track densities exceed 1000 per inch and bit densities exceed 20,000 per inch. However, the reduction of impurities reduces the hardness of the now almost pure aluminum substrate. This makes such processes as polishing harder to preform.

U.S. Pat. No. 4,393,628 teaches a method and shows a media composition and structure that produces superior results in superfinishing the contemporary magnetic disk substrates. To polish the recently developed substrates of purer alloys, it is necessary to have a polishing material which remains durable and yet will still polish the softer, higher purity aluminum alloys.

SUMMARY OF THE INVENTION

The improved polyurethane foam fixed abrasive media combines two surfactants commonly used in the foam industry. However the two surfactants, when combined in accordance with the present invention, produce a synergistic result not previously obtained.

The system of the present invention uses a combination of hydrophilic and hydrophobic surfactants. The hydrophobic surfactant, when used as the sole silicone surfactant, produces a pad which is not stable and tends to break down under polishing pressure. The hydrophobic silicone copolymer also remains extremely pliable and does not cure out completely. This lack of curing is evident after a number of parts have been processed. The pads themselves tend to absorb the polishing vehicle and begin to swell, leading to the pads premature failure. The hydrophilic surfactant, when used alone results in a pad that is extremely durable, but also extremely high in durometer. Such a formulation works well for the harder disk substrate alloys, but results in surface damage of the substrate when used with the purer aluminum alloys.

The combination silicone surfactant of the present invention produces a urethane abrasive foam which remains durable and is able to polish the higher purity aluminum alloys to an ultra smooth surface finish. The formulation taught uses a small quantity of hydrophobic silicone surfactant in combination with an even smaller quantity of hydrophilic silicone surfactant. The amount of hydrophilic surfactant is approximately 10% by weight of the quantity of hydrophobic surfactant.

The amine catalyst concentration used in the formulation determines the hardness induced in the final polishing pad by enhancing the cross linking between the isocyanate and polyol constituents which form the polyurethane binder. Too little catalyst results in a soft polishing pad that lacks durability and satisfactory polishing qualities as the media tends to wobble, while more than an optimum concentration causes a hardness that results in scratching of the substrate workpiece.

The formulation taught reduces the aging of the polyurethane foam which normally happens in a one component silicone surfactant formulation. The formulation also has decreased air/$CO_2$ generation in the resin of the polyurethane system. These bubbles cause voids in the urethane foam that collect polishing debris which may result in detrimental random scratching of the substrate surface. The system enables the use of a higher density pad in polishing. Foams have been made from 0.5 to 0.9 grams per cubic centimeter density, with greatest durability obtained when the density was in the range of 0.62 to 0.9 grams per cubic centimeter. In the formulation taught, the blowing agent may vary up to 18% without severely affecting the surface finish of the substrate polished or characteristics of the foam. Curing the binder at a lower temperature for a longer time improves the quality of the polyurethane binder material. Temperatures below 300 degrees F. yield better characteristics and also improve the shelf life stability of the foam. There is also a direct relationship between the preheat temperature of the mold prior to the foam addition and the quality of the surface finish.

Using the media of this invention with polishing apparatus such as illustrated in U.S. Pat. No. 4,393,628 it is possible to achieve surface finishes on the purer aluminum rigid magnetic disk media substrates of 0.2 micro inches arithmetic average (AA) roughness. The present standard which is sought is in the region of 0.3 micro inches AA. This will become even more difficult to attain as purer aluminum substrate materials are used.

BRIEF DESCRIPTION OF THE DRAWING

The block diagram of the figure schematically illustrates the steps of the process used in the present invention.

DETAILED DESCRIPTION

Figure 1:
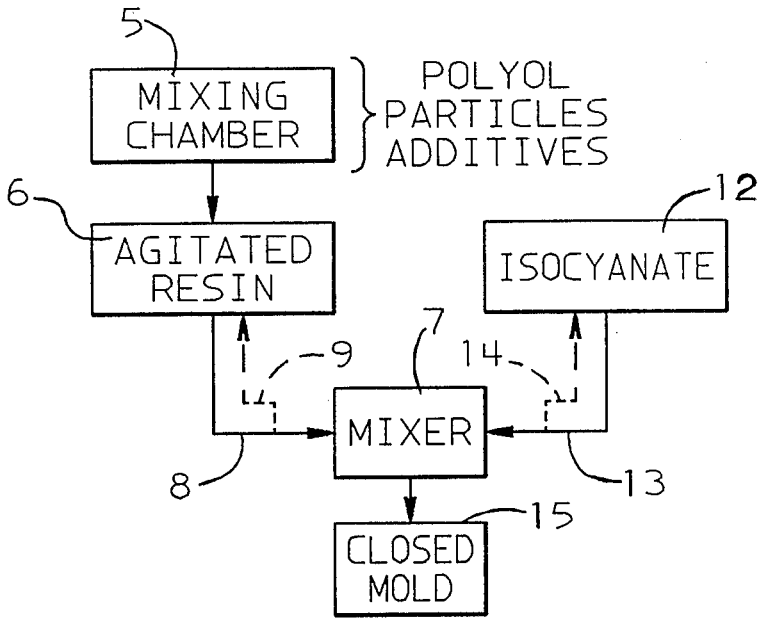

The polishing media comprises aluminum oxide particles in a polyurethane binder which is formed using a closed mold method. A mixture of hydrophobic and hydrophilic silicone surfactants are used to achieve the required durability and stability of polishing pads used to superfinish the surfaces of high purity aluminum alloys.

The polishing pad formulation using the dual surfactants is as follows:

| Component | Parts by weight |
|---|---|
| Polyisocyanate | 50 |
| Polyester polyol | 50 |
| Aluminum oxide particles | 100 |
| Hydrophilic silicone surfactant | 0.10 |
| Hydrophobic silicone surfactant | 1.0 |

-continued

| Component | Parts by weight |
|---|---|
| Blowing agent ($H_2O$) | 0.45 |
| Amine catalyst | 0.85 |

The composition may be varied using concentrations of blowing agent from 0.35 to 0.50 parts by weight. The catalyst concentration may vary from 0.6 to 1.0 parts. The abrasive particle content is 50% by weight of the formulation plus or minus 5%. The aluminum oxide abrasive particles are classified particles in the size range of 2.0 to 2.5 microns. The surfactant concentrations of the two component system may be varied using 0.05 to 0.40 parts of hydrophilic surfactant and 0.95 to 1.05 parts for the hydrophobic surfactant. Optimum results are achieved when the hydrophilic surfactant is present with a weight per cent concentration of 10 to 15% of the hydrophobic surfactant, although concentrations of 5 to 20% of the hydrophobic silicone surfactant produce successful media.

The catalyst varies the reaction or cure time. In the present environment, the amine catalyst opens reactive sites of the polyol and isocyanate constituents to increase the cross linking and consequently the rigidity of the resulting urethane foam binder. In the above system using 100 parts by weight of abrasive particles and 50 parts by weight each of polyol and isocyanate, various concentrations of amine catalyst were used. Typical of such amine catalysts is the tertiary amine, 2,4,6-tri[-dimethyl aminol methyl] phenol. Using 0.75 parts by weight or less caused the resulting pads to absorb excessive amounts of water leading to mushrooming. This failure to maintain dimensional stability shortens the useful life of the pad and impairs the ability to successfully polish pure metal substrates during pad life. Catalyst quantities of 0.95 parts by weight and greater result in finished pads with excellent dimensional stability, but the hardness causes the pads to scratch the surface being polished and thereby fails to produce a superfinished surface on pure aluminum substrates. The optimum durability while achieving the specified superfinished surface was attained with catalyst concentrations of 0.8 to 0.85 parts by weight.

The isocyanate and polyol used in equal quantities by weight have an NCO/OH ratio of reactive sites in the range of 0.73 to 0.8. The isocyanate has more than two reactive NCO sites per chain which leads to cross linking and rigidity. Also since the number of OH reactive sites in the polyol substantially exceeds the number of NCO reactive sites of the isocyanate, the cure cycle causes substantially all the NCO sites to be fully reacted during cure.

The polyol, aluminum oxide particles and blowing agent are mixed together until the particles produce a homogenous resin. The surfactants are mixed for one minute and added to the resin which is then mixed for two to three minutes before adding the catalyst to the mixture. After addition of the catalyst, the mixture is mixed for an additional five minutes. The resin mixture is continuously monitored to ensure that the the resin temperature does not exceed 120 degrees F. Should a higher temperature occur, the probability of producing an acceptable polishing pad is diminished.

The resin and polyisocyanate are combined using a two-stage foam machine. The resin and polyisocyanate are mixed in the mixing chamber for a few seconds and poured into a preheated closed mold. The mixture is then cured in the mold at 250 degrees F. for 25 minutes.

Another property that can be varied in the process of fabricating the media is the density. The following table shows various densities and hardness factors caused by charging the closed mold with varying quantities of the resin/isocyanate mixture. The media was formulated using 1 part by weight hydrophobic silicone surfactant, 0.1 part by weight hydrophilic silicone surfactant and 0.85 parts by weight catalyst.

| Density | Hardness Durometer Shore D | |
|---|---|---|
| gms/cc | Initial | Final |
| 0.62 | 32–50 | 11–20 |
| 0.67 | 42–48 | 13–30 |
| 0.73 | 46–50 | 20–35 |
| 0.79 | 40–60 | 16–29 |
| 0.85 | 53–60 | 22–42 |
| 0.90 | 52–60 | 41–52 |

The initial hardness is the density of the molded part at the end of the full cure cycle. The final hardness is the durometer of the part after placed in use and allowed to absorb moisture. Present practice is to use denser media within the range shown (0.79 to 0.9 gms/cc) however, as even purer metal surfaces are polished or superfinished, it is expected that the less dense media (0.6 to 0.75 gms/cc) may produce the optimum result.

After molding the polishing pads, the polishing surface is faced off by approximately 0.060 inch to remove the skin at the molded surface. The completed pads have a density of 0.5 to 0.9 grams per cubic centimeter. The most desirable density for polishing if from 0.62 to 0.9 gms/cc. Densities in the region of 0.5 gms/cc occasionally have a characteristic of wobbling when being worked. The hardness of the pads is in the range of 30 to 65 durometer, Shore D-scale. When worked the hardness will decrease 15 to 20 durometer.

As illustrated in the block diagram of the figure, the constituents, with the exception of the polyisocyanate, are mixed together as described above using a fast mix at a temperature not exceeding 120 degrees F. in a mixer 5. The resin mixture is then transferred to a vessel 6, in which it is agitated to maintain the uniformity of the mixture. Resin from vessel 6 is delivered to a nozzle within mixer 7 via a line 8 with a recirculating, return line 9 returning to vessel 6 from adjacent the nozzle inlet. Polyisocyanate is supplied from vessel 12 to a nozzle of mixer 7 through a line 13 which also has a recirculating, return line 14 returning to vessel 12 from adjacent the inlet side of the nozzle. The nozzle supplying the resin mixture is calibrated to deliver 30 grams per second and the nozzle supplying polyisocyanate is calibrated to deliver 10 grams per second. The resulting mixture is delivered in the quantity of a single charge to the closed mold with the mixer being cleaned by methylene chloride between shots. The closed mold 15 is preheated to 88 to 95 degrees F. and the charge is cured in the mold for 25 minutes at 250 degrees F. The mold is then chilled or quenched in water for a period such as 5 minutes to assure total cooling of both mold and part.

It has also been found that the resin mixture which is agitated and held in the vessel 6 changes or degrades over time. Mixing and holding the resin for a period of 12 to 14 hours or less does not alter the character or properties of the final molded pad, but the mixture must not be held in the mixed form from day to day, nor may the residual quantity from one batch be later used in a new batch formulation without materially changing the characteristics of the final polishing media.

What is claimed is:

1. The method of making a polishing pad for superfinishing metal substrate surfaces comprising fast mixing at a temperature of less than 120 degrees Fahrenheit the following ingredients in parts by weight:

approximately 50 parts polyol
approximately 100 parts abrasive particles
0.35 to 0.50 parts water
0.95 to 1.05 parts hydrophobic silicone surfactant
0.05 to 0.2 parts hydrophilic silicone surfactant
0.8 to 0.9 parts catalyst;

preheating a mold to 85 to 105 degrees Fahrenheit;

mixing the above initial mixture with approximately 50 parts by weight of isocyanate to form a final mixture and delivering said final mixture to said preheated mold; and curing said final mixture for 25 minutes at a temperature not exceeding 275 degrees Fahrenheit.

2. The method of making a polishing pad of claim 1 further comprising the step of quenching the cured, molded final mixture in water following the curing step.

3. The method of making a polishing pad of claim 2 wherein the water used in the initial mixing step is deionized water.

4. The method of making a polishing pad of claim 3 wherein the abrasive particles introduced during the initial mixing step are aluminum oxide not exceeding three microns in size.

5. The method of making a polishing pad of claim 1 wherein said fast mixing step and said curing step are separated by no more than 12 hours time.

6. The method for making a polishing media for superfinishing metal substrate surfaces which has abrasive particles in a polyurethane binder comprising fast mixing abrasive particles, polyol and additives to form a resin;

mixing said resin with isocyanate; and immediately forming the media in a closed preheated mold at a temperature no exceeding 275 degrees F. during cure;

wherein said additives include an amine catalyst in an amount to cause the cured media to have a durometer of 30 to 65 durometer, Shore D and a combination of hydrophobic and hydrophilic silicone surfactants having a total weight of approximately 1% of the combined weight of the polyol and isocyanate constituents with said hydrophilic silicone surfactant component being about 10 to 15% by weight of the hydrophobic silicone surfactant component.

7. The method of making a polishing media of claim 6 further comprising the step of quenching the cured, molded media in water following the curing step.

8. The method of making a polishing media of claim 7 wherein deionized water is included in the additives introduced during said fast mixing step in a quantity of 0.35 to 0.50 parts by weight per 100 parts by weight of the combined polyol and isocyanate constituents.

9. The method of making a polishing media of claim 8 wherein the abrasive particles introduced during the fast mixing step are aluminum oxide not exceeding three microns in size.

10. The method of making a polishing media of claim 6 wherein said fast mixing step and said forming step are separated by no more than 12 hours time.

* * * * *